US008523532B1

(12) United States Patent
Pohler

(10) Patent No.: US 8,523,532 B1
(45) Date of Patent: Sep. 3, 2013

(54) SEWAGE HANDLING SYSTEM, COVER, AND CONTROLS

(75) Inventor: Donald M. Pohler, North Chili, NY (US)

(73) Assignee: Liberty Pumps, Inc., Bergen, NY (US)

( * ) Notice: Subject to any disclaimer, the term of this patent is extended or adjusted under 35 U.S.C. 154(b) by 654 days.

(21) Appl. No.: 12/417,567

(22) Filed: Apr. 2, 2009

Related U.S. Application Data

(63) Continuation-in-part of application No. 11/111,113, filed on Apr. 21, 2005, now Pat. No. 7,563,082, and a continuation-in-part of application No. 11/093,133, filed on Mar. 29, 2005, now Pat. No. 7,520,736.

(51) Int. Cl.
*F04B 49/04* (2006.01)

(52) U.S. Cl.
USPC ..... 417/40; 417/423.3; 220/735

(58) Field of Classification Search
USPC ..... 417/40, 125, 126, 127, 129, 211.5, 417/297.5, 423.3; 174/660; 206/562, 563, 206/564; 220/565, 735; 241/46.01, 46.02, 241/285.2
See application file for complete search history.

(56) References Cited

U.S. PATENT DOCUMENTS

| | | | | |
|---|---|---|---|---|
| 3,198,125 | A | 8/1965 | Yuza et al. | |
| 4,080,104 | A | 3/1978 | Brown, Jr. | |
| 4,095,716 | A * | 6/1978 | Meany | 215/391 |
| 4,246,676 | A | 1/1981 | Hallsworth et al. | |
| 4,890,425 | A | 1/1990 | Mamula | |
| 5,007,450 | A * | 4/1991 | Babb et al. | 137/315.08 |
| 5,100,298 | A | 3/1992 | Shibata et al. | |
| 5,249,780 | A * | 10/1993 | Forte et al. | 266/230 |
| 5,343,890 | A * | 9/1994 | Deutch | 137/363 |
| 5,465,455 | A | 11/1995 | Allen | |
| 5,553,794 | A | 9/1996 | Oliver et al. | |
| 5,586,676 | A * | 12/1996 | Lynd | 220/212 |
| 5,806,702 | A * | 9/1998 | Sabo | 220/4.12 |
| 5,886,266 | A | 3/1999 | Stiller et al. | |
| 5,918,535 | A * | 7/1999 | Moreau | 99/413 |
| 5,924,846 | A | 7/1999 | Arnold et al. | |
| 6,059,208 | A | 5/2000 | Struthers | |
| 6,103,291 | A * | 8/2000 | Fernandez Tapia | 426/523 |
| 6,276,093 | B1 | 8/2001 | Janesky | |
| 6,305,410 | B1 | 10/2001 | Cook et al. | |
| 6,322,326 | B1 | 11/2001 | Davis et al. | |
| 6,348,657 | B1 | 2/2002 | Haslock et al. | |
| 6,430,757 | B1 | 8/2002 | Pohler | |

(Continued)

OTHER PUBLICATIONS

Zoeller Pump Co. Bulletin FM2124, Section: 3.10.005, "Preassembled Sump Pump System," 2 pages.

(Continued)

*Primary Examiner* — Devon Kramer
*Assistant Examiner* — Thomas Fink
(74) *Attorney, Agent, or Firm* — Patent Innovatiobns LLC; John M. Hammond

(57) ABSTRACT

A basin for use in liquid handling, such as sewage handling. The basin is comprised of a bottom wall, a side wall, and an open top, and a hanging feature formed in the body of the basin. A basin assembly for liquid handling may include the basin, and a hanging member suspended from the hanging feature within the basin. One or more level switches may be attached to the hanging member. A sewage handling system may include the basin assembly, a top cover fastenable to the open top of the basin, and a pump disposed in the basin.

26 Claims, 15 Drawing Sheets

(56) References Cited

U.S. PATENT DOCUMENTS

| | | | | |
|---|---|---|---|---|
| 6,464,531 | B2 | 10/2002 | Eckert et al. | |
| 6,555,754 | B2 | 4/2003 | Gilmour | |
| 6,729,847 | B2 | 5/2004 | Rossman | |
| 6,752,287 | B1 * | 6/2004 | Lin | 220/254.9 |
| 6,772,782 | B2 | 8/2004 | Bogan et al. | |
| 6,823,773 | B2 * | 11/2004 | Swinford et al. | 99/426 |
| 2004/0018094 | A1 | 1/2004 | Rossman | |
| 2005/0034383 | A1 | 2/2005 | Allen | |
| 2006/0093492 | A1 | 5/2006 | Janesky | |
| 2006/0228222 | A1 | 10/2006 | Pohler | |
| 2006/0239829 | A1 | 10/2006 | Pohler | |
| 2009/0050721 | A1 * | 2/2009 | Werner et al. | 241/30 |

OTHER PUBLICATIONS

Zoeller Pump Co. "Crawl Space Pumping system," from www.zoeller.com/zcopump/products/homeimprove/crawlspace.htm. Jan 24, 2005 4 pages.

Saber Industries, "Saber Sump Pit," from www.saber.lheengineer.com/main1.html. 4 pages.

Commonly owned pending U.S. Appl. No. 10/963,191, "Sump Enclosure and Assembly," filed Oct. 12, 2004.

* cited by examiner

SEWAGE HANDLING SYSTEM, COVER, AND CONTROLS

CROSS-REFERENCE TO RELATED PATENT APPLICATIONS

This application is a continuation-in-part of commonly owned copending U.S. patent application Ser. No. 11/093,133, and commonly owned copending U.S. patent application Ser. No. 11/111,113, the disclosures of which are incorporated herein by reference.

This invention relates in one embodiment to a liquid vessel and a cover thereof, and more particularly to a sewage handling system, a cover for a sewage basin, and control accessories disposed therein.

BACKGROUND

1. Field of the Invention

A sewage handling system, a cover assembly for a sewage basin, a basin assembly, and control accessories disposed within a sewage basin for receiving and distributing sewage via a pump housed in the basin.

2. Description of Related Art

In general, sewage may be distributed from a sewage source to a desired location by gravity flow or by pumping. For example, for residential sewage, all sources of sewage in the residence may be located higher than the public sewer or septic tank connection, and the sewage may be transported to the connection solely by gravity flow. However, if a sewage source is located at a lower elevation than the sewer line connection as often occurs, it becomes necessary to pump sewage uphill to the connection. For example, a toilet may be installed in a bathroom located in a basement where the sewer line connection is located higher than the toilet.

Sewage basin assemblies may be installed to deliver sewage from a source to the desired sewer line connection. These assemblies typically include a container having an inlet, where sewage is received from the sewage source, and a pump for pumping received sewage to an outlet of the container, the outlet for connection to a sewer line leading to the public sewer or septic tank. For example, Liberty Pumps of Bergen, N.Y. manufactures and sells sewage basin assemblies as the "370-Series" that comprise a polyethylene basin with an inlet nub adapted to be connected to a sewage source, a cover for the top of the basin, a pump mounted in the basin, and an outlet pipe extending from the pump to outside the cover. Such basins are rotationally molded in a multi-part mold having a part-line parallel to the basin bottom that dissects the body inlet nub. The various components also may be sold individually for custom assembly at a job site. The basin may be installed immediately beneath the foundation, for example, such that the top of the basin is flush with the foundation slab, or located underground beyond the foundation and backfilled with soil. In either case, the inlet to the ejector system is in connection with the sewage source, and the outlet is in connection with a line running to the public sewer, a septic tank or alternate sewage treatment device.

Heretofore, certain patents and publications have disclosed sewage basin assemblies, and related structures such as U.S. Pat. No. 6,305,410 of Cook et al., the disclosure of which is incorporated herein by reference. This patent discloses a sewage ejector system including a basin and top cover. The basin body thereof includes a generally cylindrical wall, a closed bottom, and an open top.

U.S. Pat. No. 6,430,757 of Pohler discloses a self-contained bathroom waste collection and disposal unit having a reservoir configured to operably retain a pump and a float-operated switch. The reservoir cooperates with a primary cover having plumbing and electrical access ports, and a secondary cover free of connecting ports that is readily removed to permit convenient access to the reservoir, including the switch (e.g., to replace the switch) and the pump inlet (e.g., to remove clogs). The unit further includes integral, molded features for retaining the switch and pump in an operable position, such as e.g., a boss on the cover prevents displacement of the pump, and molded-in torque stops prevent rotational movement of the pump; thereby absorbing the torque of the pump as it operates and correspondingly reducing stress on plumbing joints. The unit further includes molded-in strengthening collars and recesses sized to assist in transporting and installing the unit.

Although these and other sewage basin assemblies may operate in a satisfactory manner with respect to the basic sewage handling function, there is a need for better accessibility to the internal components of the sewage basins, and for a greater ease of assembly and adjustability of certain components. Opportunities remain for improvement of sewage basin assemblies in order to address problems heretofore unsolved. There is a need for a sewage basin assembly having in particular a cover that provides improved fastening means, gaskets and seals, electrical connections, and plumbing connections, in order to simplify the installation, plumbing, wiring, and general assembly thereof. There is also a need to provide a sewage handling system having a lower height such that in circumstances in which such enclosure is to be placed in a pit, such pit may be relatively shallow, thereby enabling installation of such enclosure in a location where the soil depth is minimal, or where the pit must be hewn in bedrock. There is also a need to provide a sewage handling system having modular electrical control components and mounting hardware therefor, in order to simplify and reduce the time of assembly of such components into the sewage handling system.

SUMMARY

In the present disclosure, one or more of these needs are met by providing a basin assembly comprised of a body comprising a bottom wall, a side wall, and an open top; a hanging feature formed in the body of the basin; and a hanging member suspended from the hanging feature within the body of the basin. The hanging feature of the basin and the hanging member may have various forms. The following are meant to be illustrative of such forms, and not limiting.

The hanging feature may be comprised of a vertical cavity, and the hanging member comprised of an elongated vertical section extending through the vertical cavity. The hanging feature may further include a horizontal portion, with the hanging member comprised of an elongated vertical section extending from an upper horizontal section, with the upper horizontal section disposed in the horizontal portion of the hanging feature. The horizontal portion of the hanging feature may be a horizontal channel. The hanging member may be a hook-shaped hanger rod including the upper horizontal section thereof disposed in the horizontal channel. The hanging feature may be comprised of an arcuate channel transitioning to the first vertical cavity, with the hanging member being comprised of an elongated vertical section extending from an arcuate-shaped upper section disposed in the arcuate channel of the hanging feature. In another embodiment, the hanging feature is comprised of a recessed pocket formed around a vertical cavity, and the hanging member is comprised of a flange disposed in the recessed pocket and an elongated vertical section extending through the vertical cavity.

The open top of the basin may include an annular flange, with the hanging feature formed in a shelf extending inwardly from the annular flange. The shelf and annular flange may be comprised of a downwardly extending lip which provides structural strength to the shelf and flange. Alternatively, the shelf including the hanging feature may extend inwardly from the side wall of the basin.

The basin assembly may be used for the handling of sewage or other liquids. In such applications, the liquid handling system is comprised of a basin assembly as described above, and a top cover fastenable to the open top of the basin. The open top of the basin may be comprised of an annular flange having a flat region, with the top cover being comprised of a perimeter including a lower annular edge surface fastenable to the annular flange. The top cover may include a flange surrounding an opening therein, with an access cover removably secured to the flange. The basin assembly may further comprise at least one level switch attached to the hanging member. The basin assembly may be further comprised of a pump disposed therein. The pump may be operatively connected by a discharge pipe to an opening in the top cover or in the basin side wall.

In accordance with the present disclosure, there is further provided a cover assembly for covering a vessel. The cover assembly comprises a main cover comprising a perimeter including a lower annular edge surface fastenable to an annular flange of a basin, at least a first opening connectable to a pipe, and a second opening surrounded by a first flat flange. An access cover is removably secured to the first flat flange of the main cover and comprises an engagement feature. The hanging or engagement feature may be comprised of a first vertical cavity and may further include a horizontal channel. A hook-shaped hanger rod may be engaged with the engagement feature of the access cover. The main cover may be comprised of at least one retaining member that is proximate to the hanging member when the access cover is fitted to the main cover. A liquid handling system including the above cover assembly may further include a basin for receiving a liquid, the basin comprising a body comprised of a bottom wall, a side wall, and an open top; and a level switch assembly comprising a hanging member engaged with the hanging feature of the access cover, and at least one level switch attached to the hanging member.

In another embodiment of a cover assembly of the present disclosure, the engagement or hanging feature may be comprised of a recessed pocket formed in one of the main cover and the access cover, with the hanging member comprising an elongated vertical section extending from an upper flange. The upper flange may be disposed in the recessed pocket of the engagement feature. In yet another embodiment of a cover assembly of the present disclosure, the engagement feature may be formed in one of the main cover and the access cover and may comprise an arcuate channel transitioning to a vertical cavity, with the hanger rod comprising an elongated vertical section extending from an arcuate-shaped upper section. The arcuate-shaped upper section may be disposed in the arcuate channel of the engagement feature.

BRIEF DESCRIPTION OF THE DRAWINGS

Embodiments in the present disclosure will be described by reference to the following drawings, in which like numerals refer to like elements, and in which.

Figure 1:
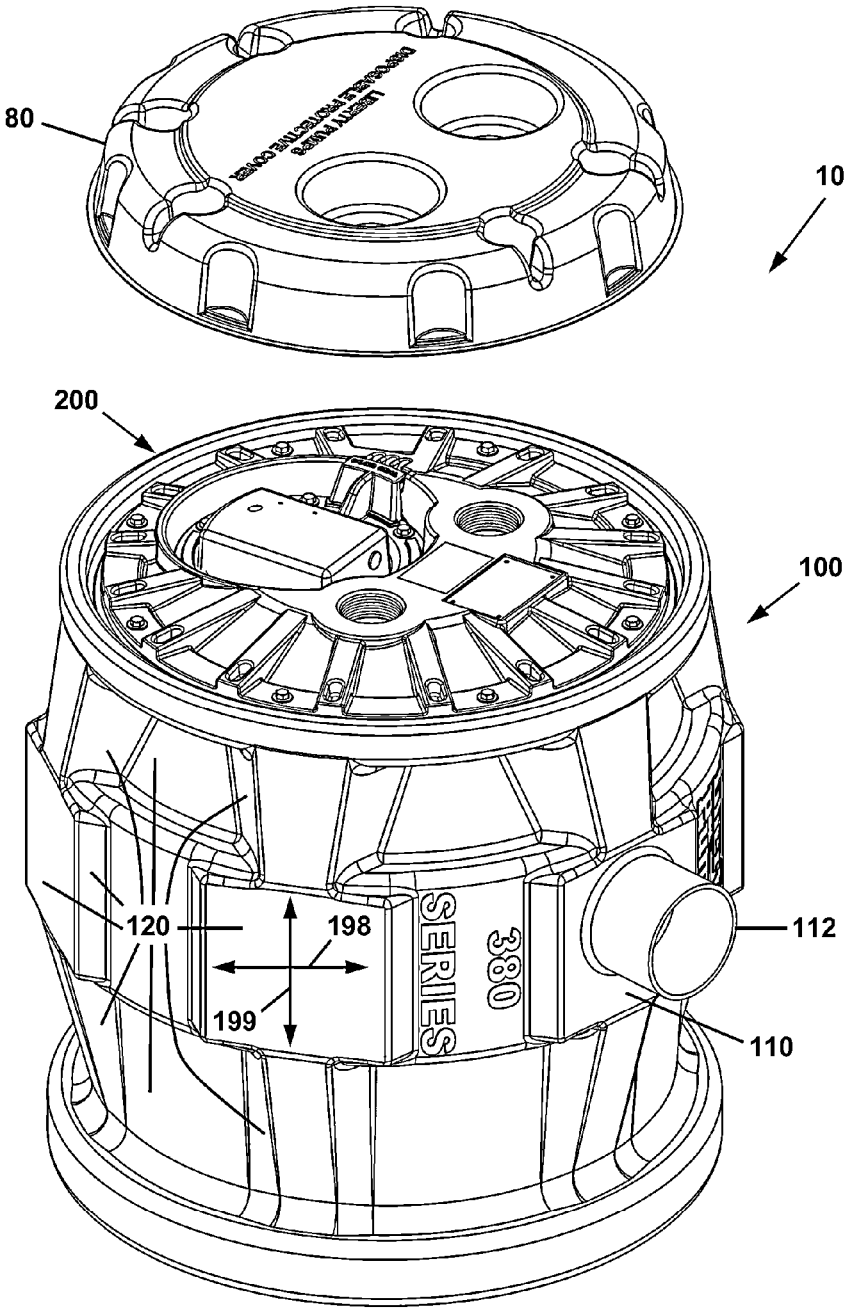
FIG. 1 is a perspective view of one embodiment of a sewage handling system including a basin, a structural cover, and a protective cover.

The inventions disclosed herein will be described in connection with preferred embodiments. However, it will be understood that there is no intent to limit the inventions to the embodiments described. On the contrary, the intent is to cover all alternatives, modifications, and equivalents as may be included within the spirit and scope of the inventions as defined by the appended claims.

DETAILED DESCRIPTION

For a general understanding of the present disclosure, reference is made to the drawings. In the drawings, like reference numerals have been used throughout to designate identical elements.

Figure 2:
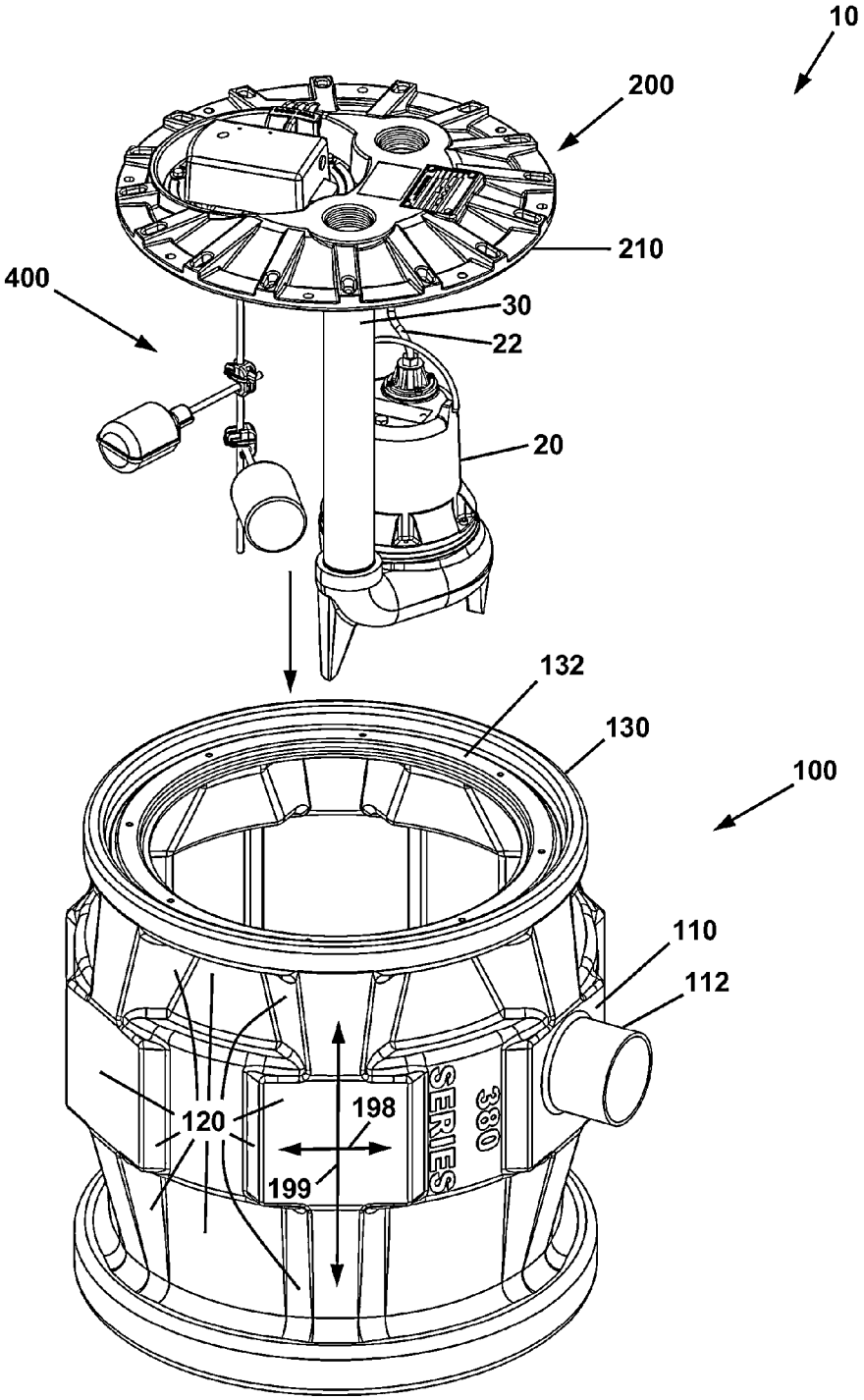
FIG. 2 is a partially exploded perspective view of the sewage handling system of FIG. 1.
Figure 3:
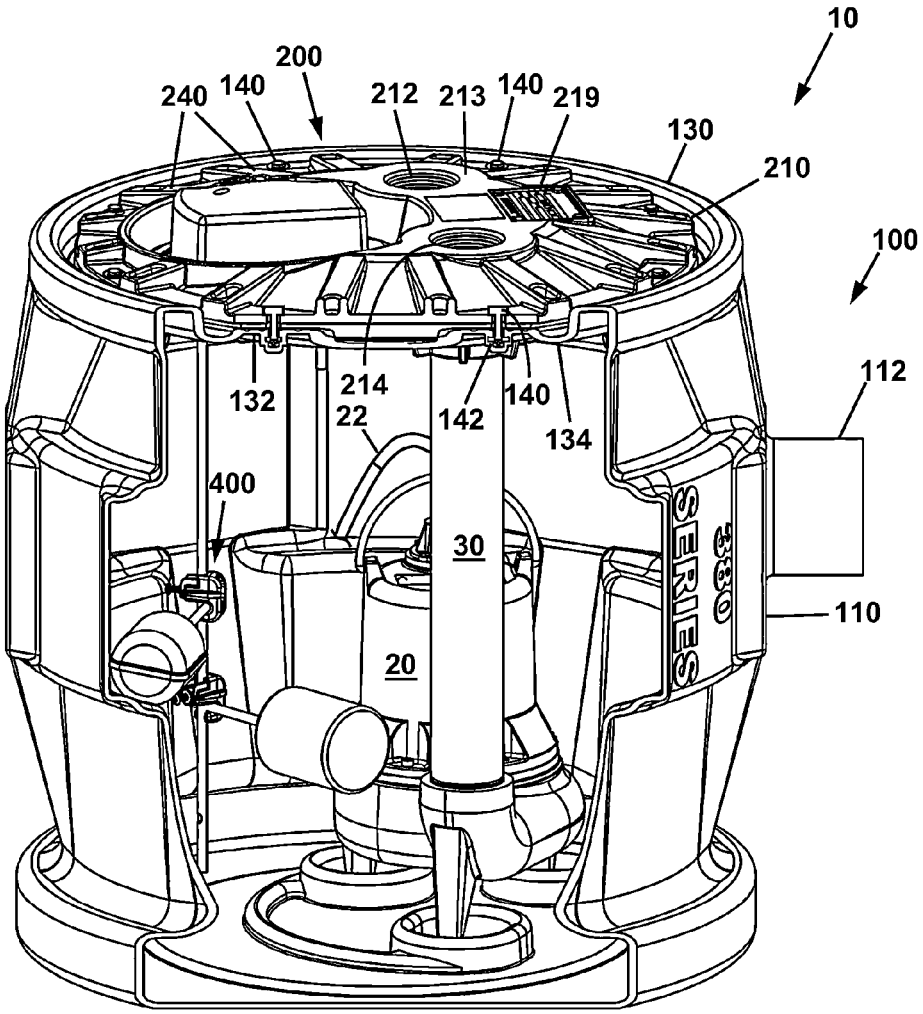
FIG. 3 is a cutaway perspective view of the sewage handling system of FIG. 1.

FIG. 1 is a perspective view of one embodiment of a sewage handling system including a basin, a structural cover, and a protective cover; FIG. 2 is a partially exploded perspective view of the sewage handling system of FIG. 1; and FIG. 3 is a cutaway perspective view of the sewage handling system of FIG. 1. Referring to FIGS. 1-3 sewage handling system 10 comprises a sewage basin 100, cover assembly 200, and float switch assembly 400. Basin 100 contains a pump 20 to which is connected a discharge pipe 30, that in turn is connected to an outlet port 214 in main cover 210.

After assembly of sewage handling system 10 at a manufacturing site, and prior to shipping, sewage basin assembly 10 may be fitted with protective cover 80, which provides protection to the cover assembly 200 of basin assembly 10 during shipping and during installation. The function of protective cover 80, and the preferred materials of construction thereof are substantially the same as disclosed in commonly owned pending application U.S. Ser. No. 10/963,191 the disclosure of which is incorporated herein by reference.

The general spatial relationships and functions of vessel or basin 100, pump 20, discharge pipe 30, and cover 210 are substantially the same as is described in U.S. Pat. No. 6,305,410 of Cook et al. Basin 100 is preferably between about 18 and 36 inches high. In one preferred embodiment depicted in FIGS. 1-3, basin 100 is provided with a height of about 24 inches. In the embodiment depicted in FIGS. 1-3, basin 100 is preferably also provided with at least one flat 110 and/or one hub 112 for connection of inlet piping thereto. In one preferred embodiment, basin 100 is further provided with a network of facets 120 formed in the wall and around the circumference thereof, effectively forming a structure having vertical ribs as indicated by bidirectional arrow 199, as well as horizontal ribs as indicated by bidirectional arrow 198, for even greater structural strength. Basin 100 is generally shorter in height than other sewage basins and thus has the advantage of a compact shape, which enables the use thereof in locations where the soil depth above bedrock or other subsurface obstructions (roots, buried cables and/or utility piping, etc.) is less than about thirty inches.

Cover 210 is preferably fastened to a flat region 132 of annular flange 134 formed at the upper edge 130 of basin 100 by the use of bolts 140 which pass through holes 280 (see also FIG. 8) in cover 210, or other suitable fastening means. In one preferred embodiment, basin 100 is provided with threaded inserts 142 molded into flange 134, for engagement with fasteners 140. Cover 210 is preferably provided with holes to accept either 8 or 16 equally spaced fasteners around the perimeter thereof for securing cover 210 to basin 100.

Figure 4:
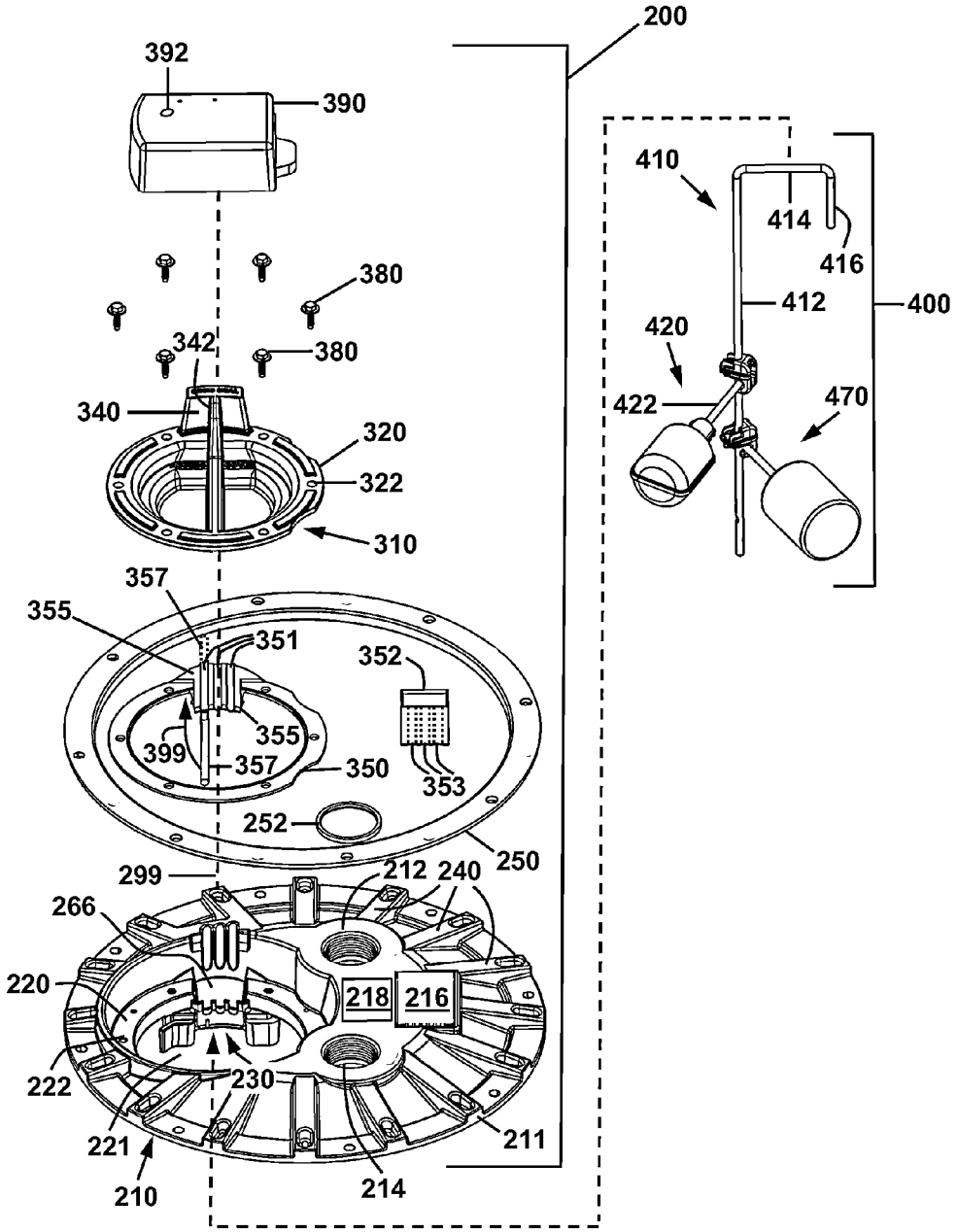
FIG. 4 is an exploded perspective view of the sewage handling system cover and float switch assemblies depicted in FIG. 2.
Figure 8:
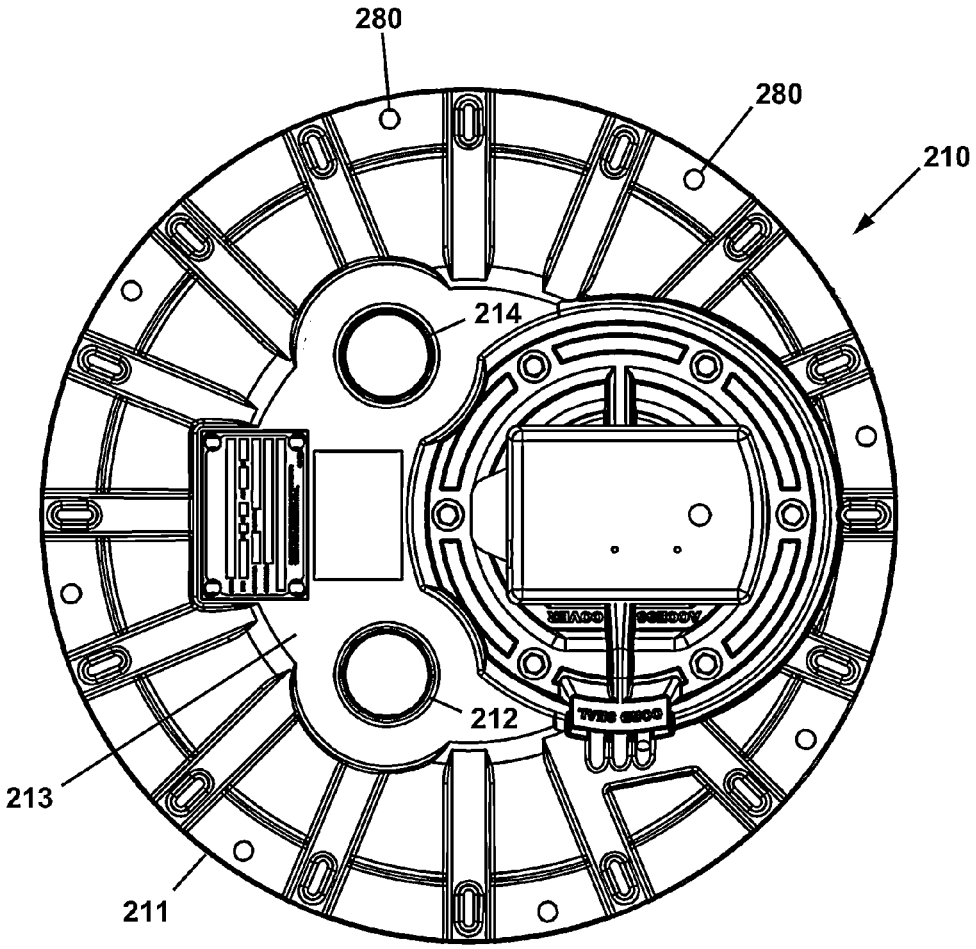
FIG. 8 is a top view of the main cover assembly of FIG. 2 in a fully assembled state.

Cover assembly 200 and cover 210 are further provided with numerous advantageous features to be described presently with reference in particular to FIGS. 3, 4, and 8. FIG. 4 is an exploded perspective view of the sewage handling system depicting cover assembly 200, and FIG. 8 is a top view of the system cover assembly 200 in a fully assembled state. Referring to FIGS. 3, 4, and 8, cover assembly 200 comprises main cover 210 and access/inspection cover 310. Main cover 210 is provided with a flat flange 220 formed therein having a plurality of holes 222 and threaded inserts 224 (see also FIG. 5) molded into flange 220. Access cover 310 is also provided with a flat flange 320 having a plurality of holes 322 formed therein, such that access cover 310 may be secured to main cover 210 by bolts 380 when flange 320 is mated with flange 220. The flange 220 may have shapes and orientations other than that depicted in FIGS. 3,4, and 8. For example, the flange 220 may have a conical shape, or a radiused shape, with the corresponding mating flange 320 of the access cover 310 having a matching shape such that the access cover 310 can be fitted to the flange 220.

Cover assembly 200 further comprises a gasket 350 that is disposed between main cover 210 and access cover 310 to provide a liquid tight seal between such covers. The gasket may be pre-formed to a shape that matches the respective flanges 220 and 320 of the main cover 210 and the access cover 310. Cover assembly 200 further comprises another gasket 250 that is disposed between main cover 210 and flat region 132 of flange 134 of basin 100 for a liquid tight seal therebetween. For the sake of simplicity of illustration in FIG. 4, gasket 250 is shown above cover 210; however, it is to be understood that gasket 250 is disposed beneath cover 210 when cover 210 is fastened to basin 100.

Figure 7:
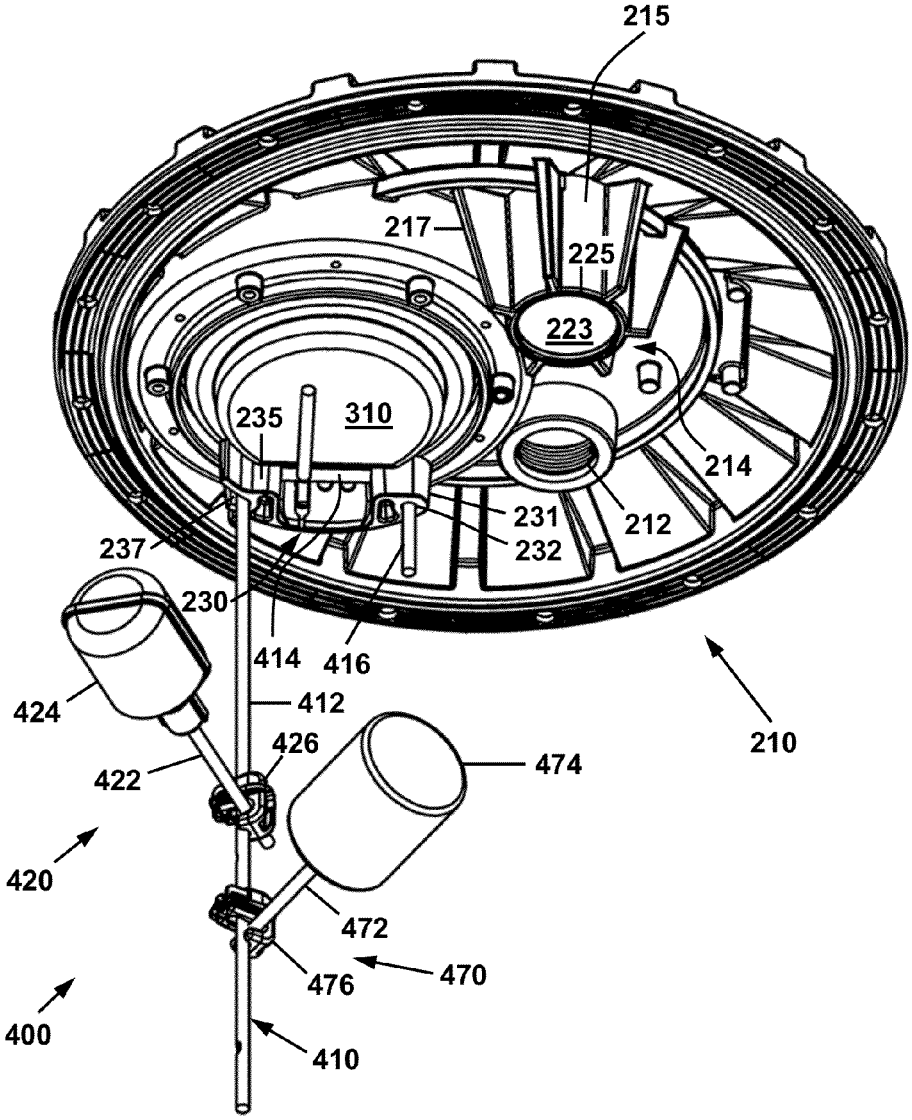
FIG. 7 is a perspective view of the main cover and float switch assemblies of FIG. 2, taken from a vantage point below the lower portion of the main cover.

In the preferred embodiment, cover assembly 200 further comprises a lip seal 252 that seals discharge pipe 32 (see FIG. 2) to outlet opening 214. Referring to FIG. 2 and FIG. 7 in particular, outlet opening 214 of main cover 210 is formed as an elongated cylinder 215 that is reinforced by gussets 217. Outlet opening 214 further comprises a hollow socket 223 into which discharge pipe 30 is inserted during assembly of system 10. Lip seal 252 is disposed in cylindrical recess 225 and around discharge pipe 30, thereby sealing discharge pipe 30 to cover 210.

When sewage handling system 100 is installed and in operation, access cover 310 is easily removed from cover 210 without the need for disconnection of any piping or electrical components. Access cover 310 thus provides ready access to float switch assembly 400 (to be described subsequently herein) and to pump 20, and for general inspection of the contents and condition of basin 100. Access cover 310 is easily replaced and resealed to main cover 210 when the need for access to basin 100 is finished.

In the embodiment depicted in FIGS. 3, 4, and 8, cover 210 is depicted as being provided with threaded outlet openings 212 and 214, such as e.g. 2 inch pipe thread. Other suitable pipe connections may also be used, such as is described and shown in FIGS. 22A-23 of commonly owned U.S. provisional patent application U.S. Ser. No. 60/487,953 of Cook et al., the disclosure of which is incorporated herein by reference.

Cover 210 is further provided with two flat recessed areas 216 and 218 to which product identification labels, such as e.g., label 219 of FIG. 3 may be fastened. Cover 210 is further provided with a plurality of ribs 240 disposed around the outer region thereof in the radial direction, which provide additional structural strength to cover 210. The upper surfaces of ribs 240 are preferably sloped upwardly from the outer perimeter 211 to the flat region 213 of cover 210. This upward slope is best seen with reference to FIG. 10, and provides greater strength to withstand vertical loads upon cover 210.

Figure 5:
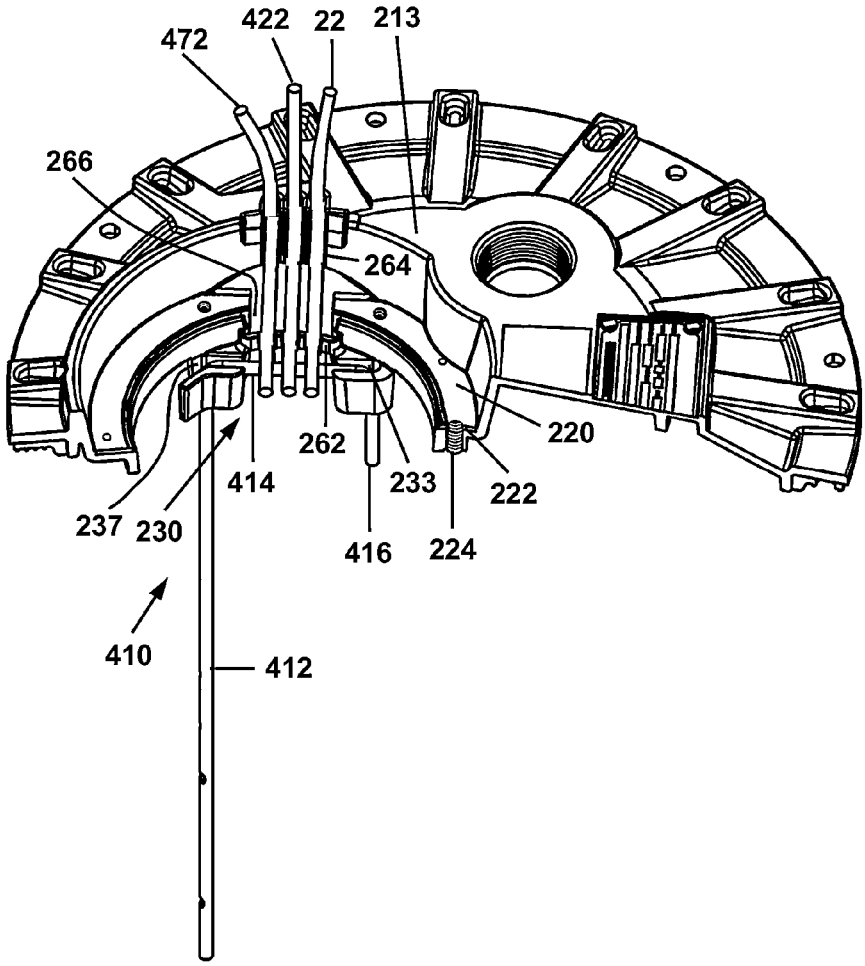
FIG. 5 is a cutaway perspective view of the main cover of FIG. 4 shown with the float support hanger rod of FIG. 4 engaged therewith.
Figure 9:
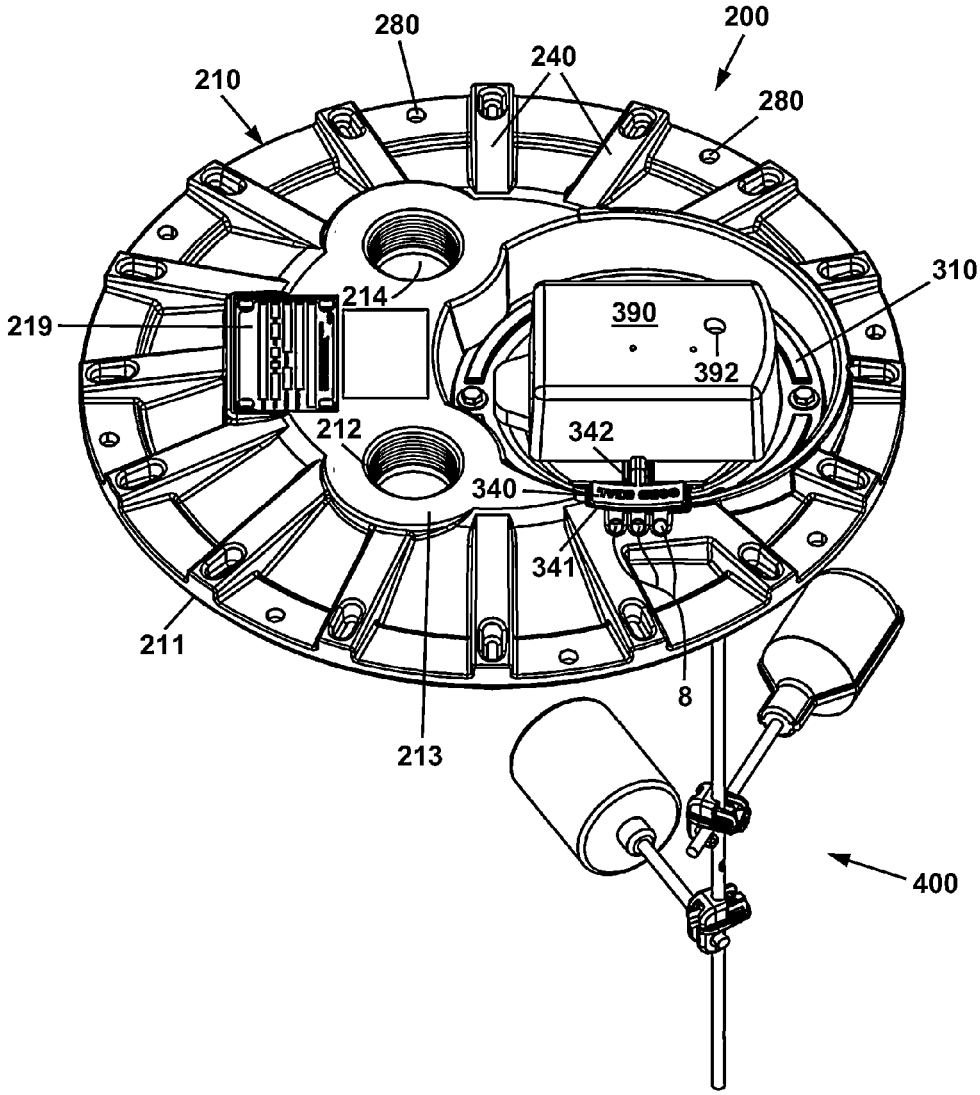
FIG. 9 is a perspective view of the main cover and float switch assemblies of FIG. 2 in a fully assembled state, taken from a vantage point that depicts the cord passageways therethrough.

One of the more advantageous features of cover assembly 200 is the provision of cord sealing means integrated therein. This provision has eliminated the need for separate cord sealing fittings to be provided in cover assembly 200. In one preferred embodiment, such cord sealing means is provided in the interface between main cover 210, access cover 310, and gasket 350 disposed therebetween, and is best understood with reference in particular to FIGS. 4, 5, and 9. FIG. 5 is a cutaway perspective view of main cover 210 of FIG. 4 showing a portion of the cord sealing means, and FIG. 9 is a perspective view of cover assembly 200 in a fully assembled state, taken from a vantage point that depicts the cord passageways through the cord sealing means thereof, and the cords disposed therein. Referring to FIGS. 4 and 5, main cover 210 is provided with a plurality of cord grooves in which cords such as e.g., cords 22, 422, and 472 may be disposed. In the preferred embodiment, main cover 210 is provided with lower cord grooves 262 and upper cord grooves 264, with the lower cord grooves being beneath the level of flange 220, and the upper cord grooves extending at an upward angle from near the level of flange 220 upwardly to the level of top surface 213 of cover 210.

A gap is provided between the upper extremity of lower cord grooves 262 and the lower extremity of upper cord grooves 264. In this gap there is formed a pocket 266 for receiving and holding a cord sealing portion 355 of cover gasket 350.

Although in FIG. 5, for the sake of simplicity of illustration, cords 472, 422, and 22 are depicted as being disposed directly into cord grooves 262 and 264, it is preferable that in the assembled state, cords 472, 422, and 22 are disposed between cord sealing portion 355 of access cover gasket 350 and cord seal block 352. Cover gasket 350 is also provided with a corresponding set of cord seal grooves 351 to match lower cord seal grooves 262 and to hold cords 22, 422, and 472; and cord seal block 352 is also provided with a corresponding set of cord seal grooves 353 on the outer side thereof to hold cords 22, 422, and 472. Access cover 310 is provided with a cord seal riser 340 with an angled flat surface formed on the outer side 341 thereof, i.e. the side opposite gusset 342, to match the flat surface on the inner side of cord seal block 352.

To assemble access cover 310 to main cover 210 and seal cords 472, 422, and 22 therebetween, cover gasket 350 is placed upon flange 220 of cover 210; cords 22, 422, and 472 are run through the opening 221 for access cover 310 and are pressed into cord seal grooves 351 of cover gasket 350; cord seal block is placed over cords 22, 422, and 472 and in contact with the cord sealing portion 355 of cover gasket 350, so that cords 22, 422, and 472 are disposed in the passageways 8 formed between cord seal grooves 351 of cover gasket 350 and cord seal grooves 353 of cord seal block 352; access cover 310 is placed upon main cover 210 with the flat surface of cord seal block 352 mated against the angled flat surface of the riser 340 of access cover 310; and bolts 380 are used to secure access cover 310 to main cover 210, thereby compressing gasket 350 therebetween. Referring to FIG. 9, which is a perspective view of cover assembly 200 taken from the angle at which the cords therein are upwardly disposed, it can be seen that cords 22, 422, and 472 are routed through holes 8 and are sealed between the cover gasket 350 and the cord seal block 352, by the clamping action of access cover 310 against main cover 210, which compresses gasket 350 and cord seal block 352 to provide such sealing action.

Referring again to FIGS. 4 and 9, and in a further embodiment, the applicant's cover assembly 210 is further provided with alarm control unit 390, which, during shipping to the installation site, is disposed upon access cover 310. When sewage handling system 10 is installed, alarm control unit 390 is mounted at a suitable location nearby, such as e.g., a nearby wall, or on a sheet metal panel or other suitable surface. Referring also to FIG. 5, in the preferred embodiment, the cord 422 of alarm level switch 420 is fed upwardly through one of the cord openings formed between cord sealing portion 355 of access cover gasket 350 and cord seal block 352, and into an opening 392 in alarm control unit 390 that is mounted nearby. (For the sake of simplicity of illustration, cord 422 is not shown disposed through opening 392 in FIG. 9. However, it is to be understood that cord 422 enters control unit 390 through opening 392 and is suitably sealed at such opening.)

Electrical wires (not shown) within cord 422 are connected to further electrical switching means such as e.g. an electromechanical relay, or to communication means such as e.g. a wireless transmitter. Such further electrical switching means or communication means is further connected to or in communication with various alarm indicating means such as e.g. a light, a horn, a computer or process controller, including a video display, and the like. In operation, when the liquid level in basin 100 becomes excessively high and floats level switch 420 upwardly, the contacts within level switch 420 change state (open-to-closed or vice-versa), and an alarm condition is indicated by the alarm indicating means.

Figure 6:
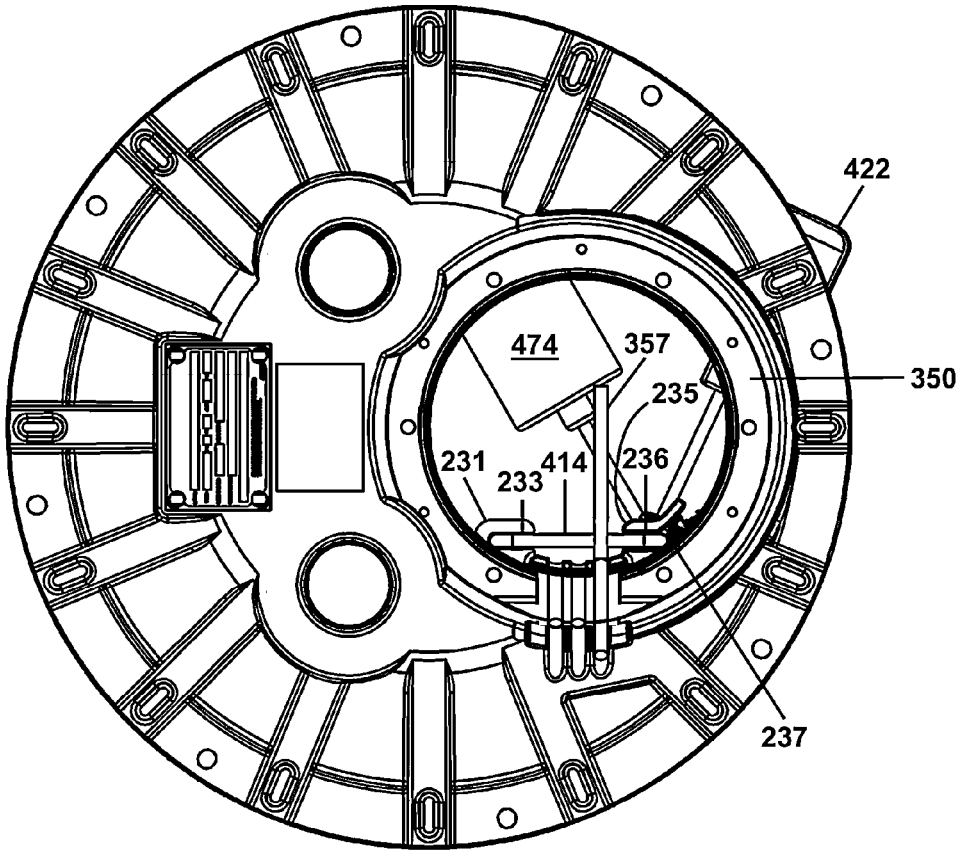
FIG. 6 is a top view of the main cover and float switch assemblies of FIG. 4, with the access cover removed from such main cover.
Figure 10:
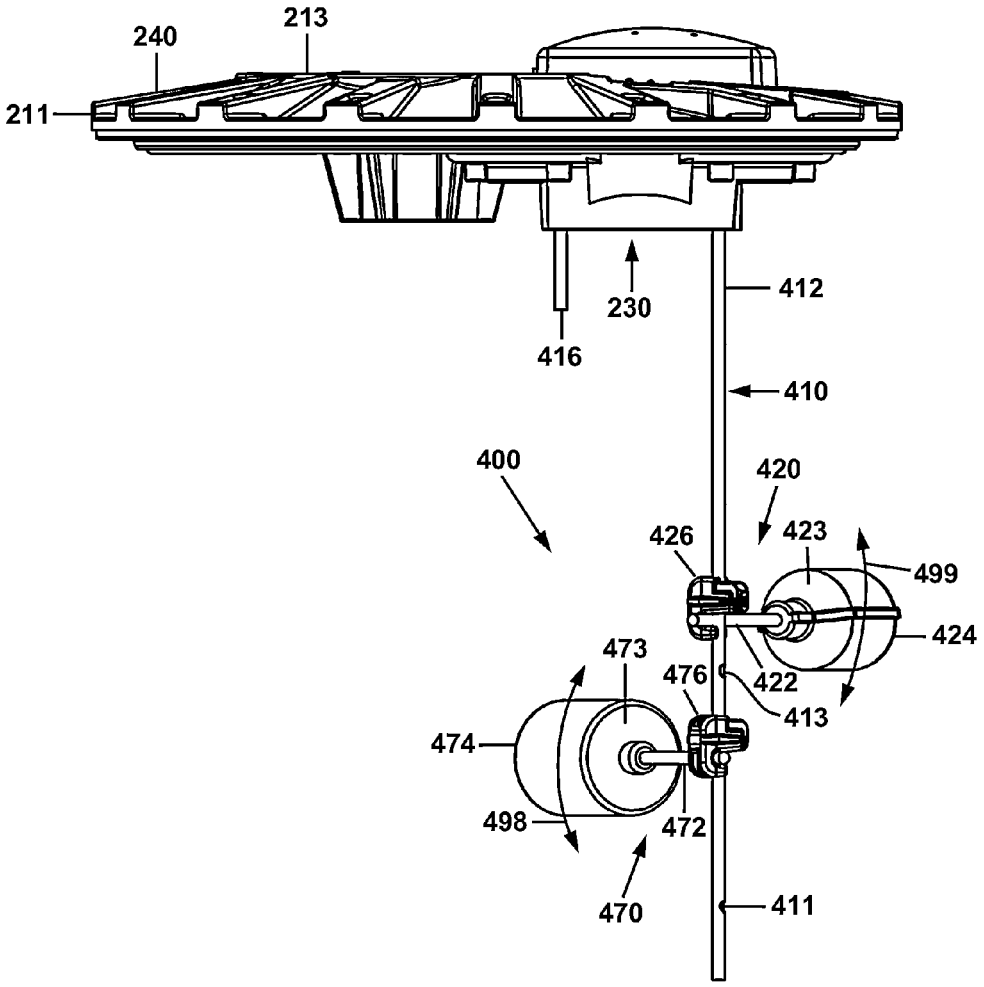
FIG. 10 is a side view of the main cover and float switch assemblies of FIG. 2 in a fully assembled state.

A more detailed description of the level control means of the applicant's sewage handling system is now provided, such level control means being one of the more advantageous features of sewage handling system 10. Such level control means is easily installable, removable, and adjustable. This provision, together with the provision of access cover 310, enables easy installation of level switches during assembly of sewage handling system 10, and subsequent removal, replacement, and/or adjustment at any time thereafter. In one preferred embodiment, such level control means comprises one or more float-type level switches mounted on a removable hanger rod, and is best understood with reference in particular to FIGS. 4-7 and FIG. 10. FIG. 4 is an exploded perspective view of the sewage handling system cover assembly 200 and float switch assembly 400 depicted in FIG. 2; FIG. 5 is a cutaway perspective view of the main cover of FIG. 4 shown with the float support rod of float switch assembly 400 of FIG. 4 engaged therewith; FIG. 6 is a top view of the main cover and float switch assemblies of FIG. 4, with the access cover removed from such main cover in order to view float switch assembly 400 therebeneath; FIG. 7 is a perspective view of the main cover and float switch assemblies of FIG. 2, taken from a vantage point below the lower portion of the main cover; and FIG. 10 is a side view of the main cover and float switch assemblies of FIG. 2 in a fully assembled state.

Referring to FIGS. 4-7 and FIG. 10, float switch assembly 400 comprises hanger rod 410, a first float switch 420 and preferably a second float switch 470. Hanger rod is preferably formed as a hook with an inverted J-shape, and comprises an elongated vertical section 412, a cross bar section 414, and a short vertical section 416, with sections 412 and 414 and sections 414 and 416 being joined at junctions of approximately 90 degrees. In one preferred embodiment, hanger rod 410 is formed of a 5/16-inch diameter stainless steel rod that is bent to form the 90 degree junctions. In an alternate embodiment, (not shown), hanger rod may have a hook shape comprising a simple L-shape, wherein the horizontal portion of the L is engaged with an engagement feature in cover 210. In other embodiments (not shown), the hook shape may be formed as a T-shape, or as a small flange, with the operative requirement being that hanger rod hooks onto and is supported by an engagement feature in cover 210.

In the preferred embodiment depicted in FIGS. 4-7 and FIG. 10, elongated vertical section 412 of hanger rod 410 is provided for the securing and locating of float switches thereupon. The upper portion of elongated section 412, cross bar 414, and short vertical section 416 form a hook shape, which may be engaged with a suitable engagement feature in cover assembly 200. In the preferred embodiment, there is provided an engagement feature 230 in main cover 210 for the attachment and suspension of hanger rod 410 and float switch assembly 400 therebeneath. Referring again to FIGS. 5-7 and FIG. 10, engagement feature 230 comprises a first section 231 having a horizontal channel 233, which transitions to a vertical hole 232. First section 231 is formed to accommodate a portion of cross bar 414 and short vertical section 416, and the 90 degree elbow therebetween, of hanger rod 410. Engagement feature 230 further comprises second section 235 having horizontal channel 236, which transitions to vertical notch 237. Second section 235 is formed to accommodate a portion of cross bar 414 and elongated vertical section 412, and the 90 degree elbow therebetween, of hanger rod 410.

It will be apparent that alternatively, vertical hole 232 could instead be formed as a vertical slot similar to vertical notch 237, and still receive vertical section 416 of rod 410. It will be further apparent that rod 410 could be formed with a hook shape other than a right-angled J-shape, such as an arcuate J-shape, with the corresponding channel-and-notch or hole cavity structure being formed in a corresponding shape to receive such hook shape. A right angle J is preferred, however, for ease of manufacturing. It will also be apparent that hook-shaped rod 410 could be provided with two elongated sections forming a U-shape, or even branches of elongated sections for the attachment of level control means, and other control means thereto.

Referring in particular to FIGS. 5 and 6, in the assembled state, hanger rod 410 is engaged with engagement feature 230 of cover 210 such that short vertical section 416 is disposed in hole 232, elongated section is disposed in notch 237, and cross bar 414 is disposed in channels 233 and 236. Thus hanger rod is easily and removably engaged with and hung from engagement feature 230 of cover 210. For the sake of simplicity of illustration, float switches 420 and 470 are not depicted in FIG. 5; however it is to be understood that in operation, at least one float switch, and preferably two float switches are provided as depicted in FIGS. 2-4, 6-7, and 9-10. In the preferred embodiment wherein two float switches 420 and 470 are present, the lower of the two float switches, i.e., float switch 470 is used for on-off operation of pump 20 (see FIG. 2), and the higher of the two float switches, i.e., float switch 420 is used as an alarm switch that provides an indication of when basin 100 is excessively full, and possible intervention is required.

Referring now in particular to FIG. 10, and in the preferred embodiment depicted therein, cord 422 of float switch 420 is secured to elongated vertical rod 412 by clamp 426, or by other suitable means, such as plastic cable ties and the like. In like manner, cord 472 of float switch 470 is secured to elongated vertical rod 410 by clamp 476. Clamps 426 and 476 secure flexible cords 422 and 472 to elongated vertical rod such that floats 424 and 474 rise and fall vertically as indicated by arrows 499 and 498 respectively. Cords 422 and 472 are flexible and act as tethers to floats 424 and 474. Thus, such floats also rotate such that the central axes of such floats are oriented in a "downward" direction when the liquid level is beneath such floats, i.e. the cord end 423 of float 424 faces upwardly, and cord end 473 of float 474 faces upwardly. When the liquid level rises above the attachment points of clamps 426 and 476, floats 424 and 474 rotate such that the central axes of such floats are oriented in an "upward" direction, i.e. the cord end 423 of float 424 faces downwardly, and cord end 473 of float 474 faces downwardly. Switching means are contained within floats 424 and 474 so that at some point during these rotational transitions, electrical contacts are switched, indicating the rising or falling of liquid level above or below such float switches. It is to be understood that in FIGS. 2-10, cords 22, 422, and 472 are shown as being terminated near their respective components, but that such cords run continuously up through the cord sealing means described herein.

It will be apparent that many different types of float switches may be affixed to rod 412 to provide level control capability for system 10. By way of illustration, and not limitation, a Model 61130A0 10PMD1WP float switch manufactured by the SJE-Rhombus Corporation of Detroit Lakes, Minn. may be used. For the sake of simplicity of illustration in the drawings provided herein, the cords of such float switches are not shown. However, it is to be understood that in FIGS. 2-10, cords 22, 422, and 472 run continuously up through the cord sealing means described herein.

In one embodiment, float switch assembly 400 of sewage handling system 10 is provided with only a single float switch, which functions to provide switching for on-off operation of pump 20 (see FIG. 2), However, in the preferred embodiment depicted in the drawings herein, there is provided a system 10 with a float switch assembly 400 having two switches 420 and 470. In operation, the function of upper switch 420 is to provide high liquid level alarm capability, and the function of lower switch 470 is to provide switching for on-off operation of pump 20 as recited previously. It will be apparent that the level setpoints of each of these switches 420 and 470 may be varied by adjusting the positions thereof on elongated vertical rod 412. In the preferred embodiment, rod 412 is provided with a plurality of notches 411, 413, etc., or other suitable reference etchings or indicia for the desired placement of float switches 420 and 470 on rod 412.

It will also be apparent that alternatively, such engagement feature 230 could be provided in access cover 310, so that when access cover 310 is unbolted and lifted from cover 210, level switch assembly 400 is also removed from basin 100. It is preferable, however, that level switch assembly 400 be left in place, and that the removal of access cover 310 simply provides access to level switch assembly 400 and other components of basin 100.

In the preferred embodiment depicted in the drawings herein, wherein sewage handling system 10 comprises a pump 20, a first float switch 420 and a second float switch 470, there is a total of three cords 22, 424, and 474 (see FIG. 5) to be sealed by the cord sealing means described herein. In the event that system 10 is provided with a pump 20 and only one float switch 420, and only two cords 22 and 424 to be sealed, access cover gasket 350 is provided with a hinged finger 357 that may be placed in one of cord sealing grooves 351 of gasket 350. Referring to FIGS. 4 and 6, sealing finger 357 is formed as an integral part of gasket 350, and is hingably attached thereto. If only two cords are present to be sealed in cord sealing grooves 351, sealing finger 357 is hingably rotated upwardly as indicated by arrow 399 of FIG. 4, and is disposed in the corresponding sealing groove, thereby plugging such sealing groove when access cover 310 is secured to main cover 210.

In accordance with the present disclosure, there is further provided a basin for use in liquid handling, such as sewage handling. The basin is comprised of a bottom wall, a side wall, and an open top, and a hanging feature formed in the body of the basin. A basin assembly for liquid handling may include the basin, and a hanging member suspended from the hanging feature within the body of the basin. One or more level switches may be attached to the hanging member. A sewage handling system may include the basin assembly, and a top cover fastenable to the open top of the basin. The basin, basin assembly, and sewage handling system will now be described, and are best understood with reference to FIGS. 11-13.

Figure 11:
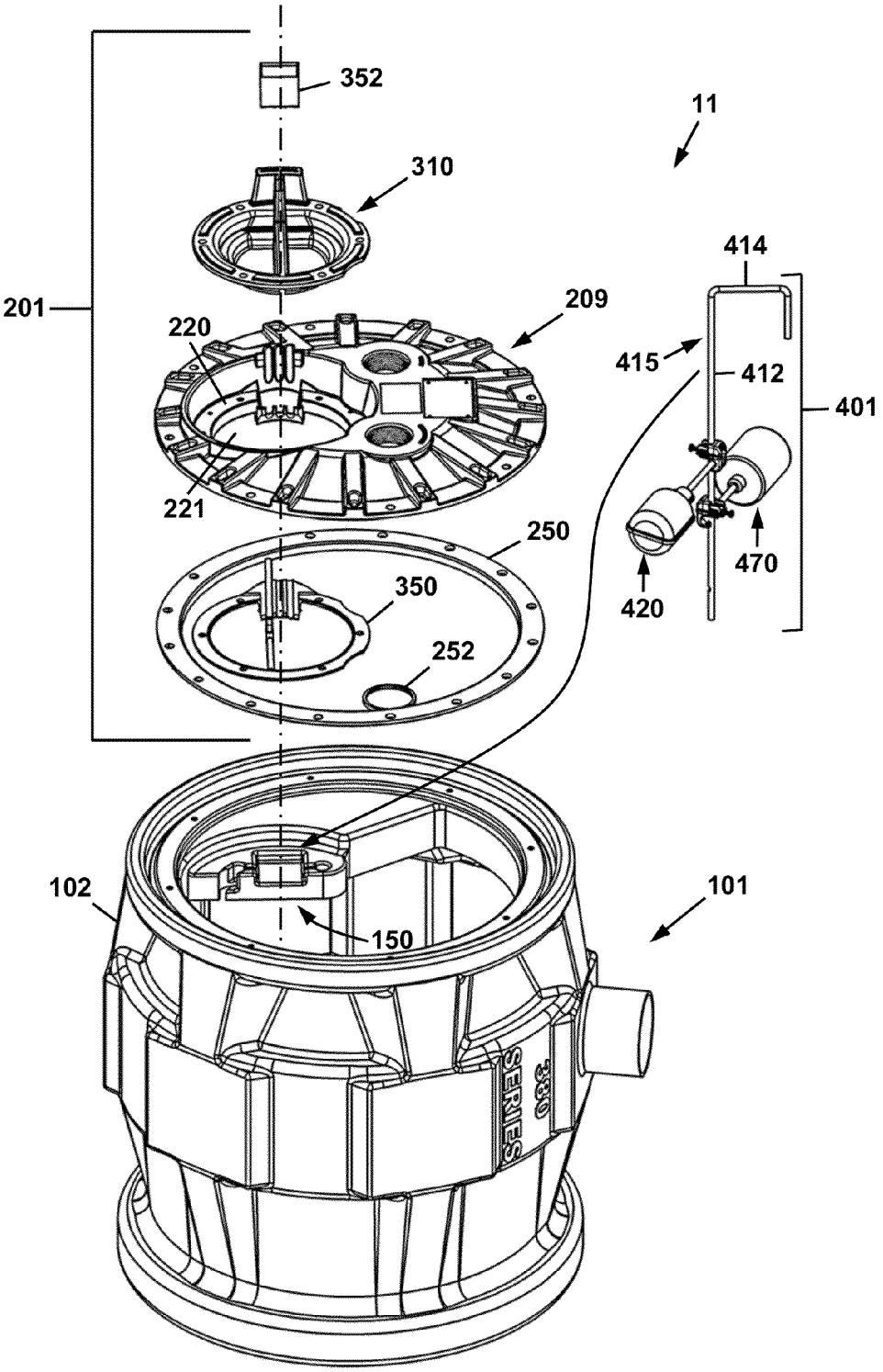
FIG. 11 is an exploded perspective view of a sewage handling system including a basin comprised of an integral hanging feature.

Referring first to FIG. 11, a system 11 for handling sewage or other liquids is comprised of a basin 101 and a cover assembly 201. The system 11 may further include a level switch assembly 401. The system 11 and cover assembly 201 are similar to the system 10 of FIGS. 1-3 and cover assembly 200 of FIG. 4, but differ significantly in certain regards. Firstly, the cover assembly 201 is not provided with an engagement feature for suspending a hanging member and level switches attached thereto. The top cover 209 of the system 11 of FIG. 11 lacks such an engagement feature, in contrast to the engagement feature 230 of the main cover 210 of the cover assembly 200 of FIG. 4; nor does the access cover 310 have such an engagement feature. Secondly, the basin 101 of the system 11 includes a hanging feature 150 for receiving and suspending the hanging member 415 and level switches 420 and 470 attached thereto. The basin 100 of the system 10 of FIG. 2 lacks such a hanging feature.

Figure 12:
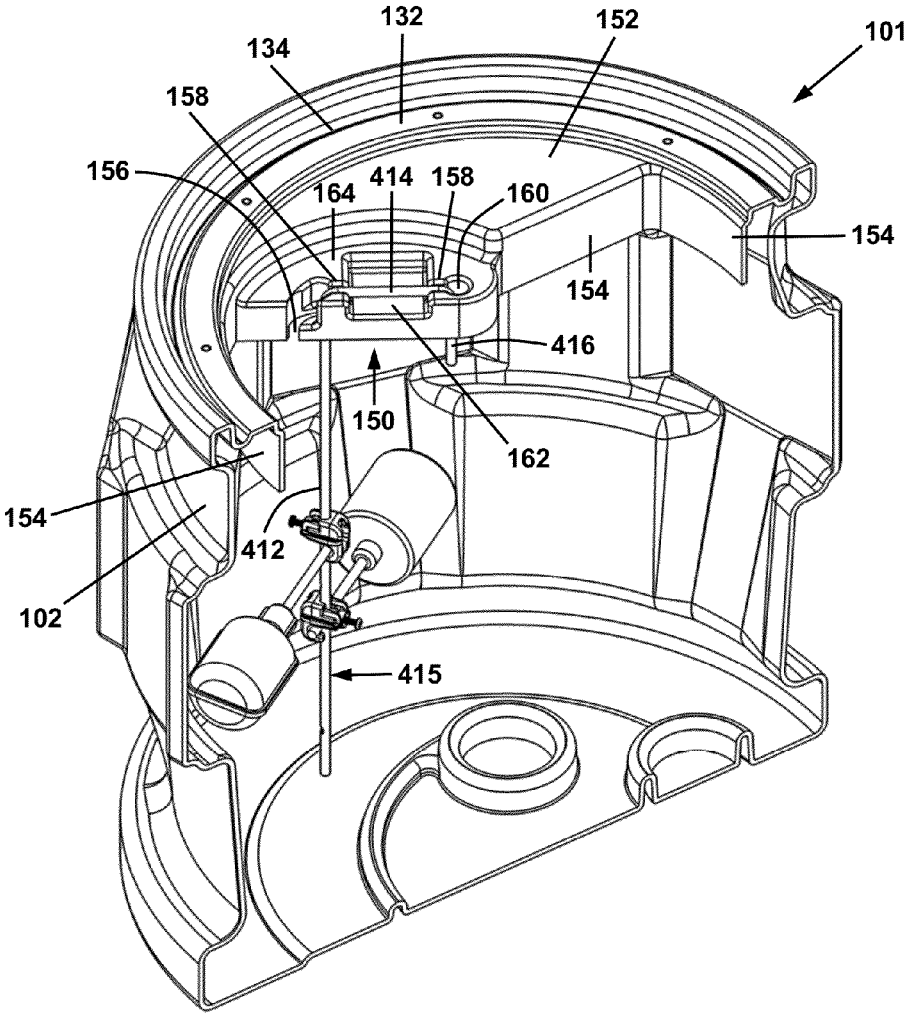
FIG. 12 is a cutaway perspective view of the basin of the sewage handling system of FIG. 11, showing a level switch assembly comprised of a hanging member engaged with the hanging feature of the basin.
Figure 13:
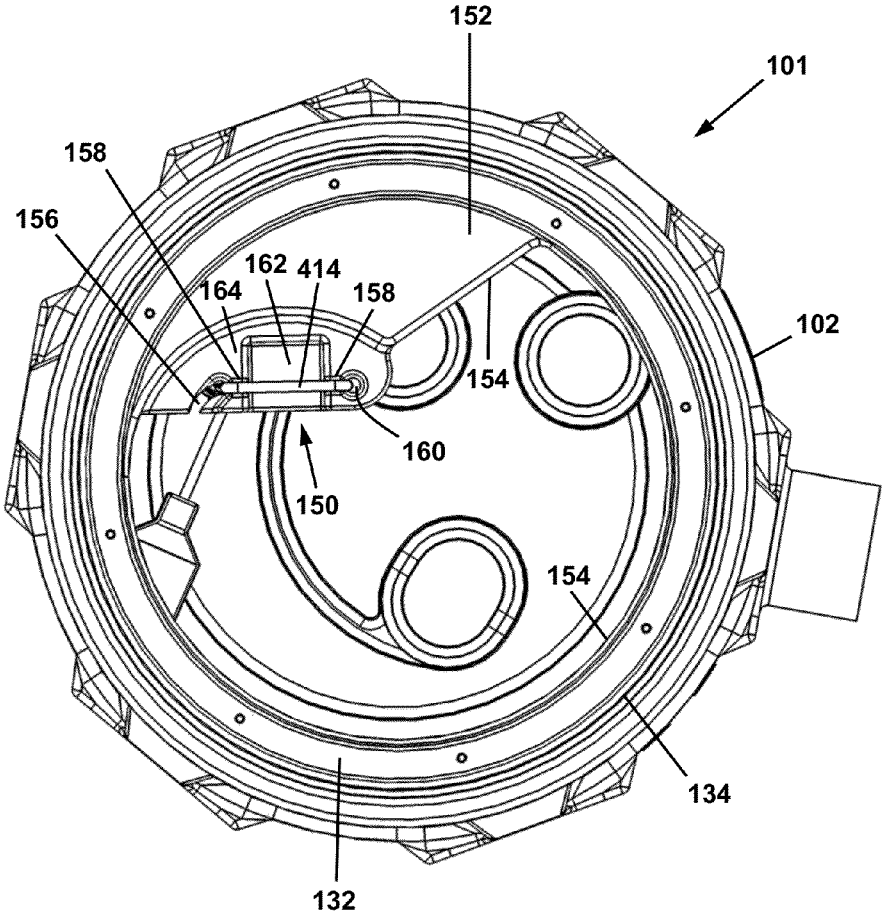
FIG. 13 is a top view of the basin of FIG. 12, including the level switch assembly and the hanging member.

Referring now to FIGS. 12 and 13, a basin 101 is provided that may be similar to basin 100 of FIGS. 1-3, but further comprises a hanging feature 150. The hanging feature 150 may be formed in a structure which extends radially inwardly proximate to the open top of the basin 101. The open top of the basin 101 may include an annular flange 134, with the hanging feature 150 being formed in a shelf 152 extending inwardly from the annular flange 134. The annular flange 134 may include a flat region 132, and the shelf 152 and annular flange 134 may be further comprised of a downwardly extending lip 154 that provides structural strength to the flange 134 and shelf 152, thereby making the shelf 152 sufficiently strong to support objects suspended therefrom. In another embodiment (not shown), the shelf 152 extends inwardly from the side wall 102 of the basin 101 instead of from annular flange 134.

A basin assembly may include the basin 101 and a hanging member 415 suspended from the hanging feature 150. The hanging feature of the basin and the hanging member may have various forms. In general, the shape of the hanging feature 150 and the hanging member 415 are formed to match each other, such that the hanging feature 150 receives the hanging member 415. The better the match of the respective shapes of the hanging feature 150 and the hanging member 415, the more firmly the hanging member 415 is secured in the hanging feature 150. The following are meant to be illustrative of such forms of the hanging feature 150 and the hanging member 415, and not limiting.

The hanging feature 150 may be comprised of a vertical cavity, and the hanging member 415 comprised of an elongated vertical section extending through the vertical cavity. In the basin 101 of FIGS. 12 and 13, the hanging feature 150 is comprised of a vertical cavity 156, with the hanging member 415 comprised of an elongated vertical section 412 extending downwardly through the vertical cavity 156. The vertical cavity 156 may be formed as a notch, such that the elongated vertical section 412 may be moved laterally into the notch when installing the hanging member 415 into the hanging feature 150. Alternatively, the vertical cavity 156 may be a through hole in the shelf 152. The hanging feature 150 may further include a horizontal portion or portions 158, with the hanging member 415 comprised of the elongated vertical section 412 extending from an upper horizontal section 414, the upper horizontal section 414 being disposed in the horizontal portion 158 of the hanging feature 150. The horizontal portion 158 of the hanging feature 150 may be a horizontal channel. The hanging member 415 may be a hook-shaped hanger rod including the upper horizontal section 414 thereof disposed in the horizontal portion 158. The hanging feature 150 may be further comprised of a second vertical cavity 160, which receives a second vertical section 416 of the hanging member. The hanging feature 150 may be further comprised of a recessed pocket 162 formed in the shelf 152. This pocket 162 provides clearance for a user's fingers to enable easy gripping and release of the hanging member 415 when a user is installing or removing the hanging member 415 into or out from the hanging feature 150.

In another embodiment (not shown), the hanging feature 150 may be comprised of an arcuate channel transitioning to the first vertical cavity 156, and the hanging member 415 may be comprised of an elongated vertical section 412 extending from an arcuate-shaped upper section disposed in the arcuate channel of the hanging feature 150. In another embodiment (not shown), the hanging feature 150 may be comprised of a recessed pocket formed around a vertical cavity, and the hanging member may be comprised of a flange disposed in the recessed pocket, with the elongated vertical section 412 of the hanging member extending downwardly from the flange through the vertical cavity.

The basin 101 and basin assembly including the hanging member 415 may be used for the handling of sewage or other liquids. In such applications, the liquid handling system 11 FIG. 3) may be comprised of a basin assembly as described above, and a top cover 209 that is fastenable to the open top of the basin 101. The open top of the basin may be comprised of an annular flange 134 having a flat region 132, with the top cover 209 being comprised of a perimeter including a lower annular edge surface fastenable to the annular flange. The top cover 209 may include a flange 220 surrounding an opening 221 therein, with an access cover 310 removably secured to the flange 220. A gasket 350 and cord seal block 352 may be further provided to provide a seal between the top cover 209 and the access cover 310, and to provide sealing around one or more cords passing between the top cover 209 and the access cover 310. These respective structures of the top cover 209, the access cover 310, the gasket 350, and the cord seal 352 may be substantially the same as those previously described herein with reference to FIGS. 4-10.

Referring again to FIGS. 11-13, in the instance wherein the cover assembly is comprised of a top cover 101 having a flange 220 surrounding an opening 221 therein with an access cover 310 removably secured to the flange 220, the shelf 152 may be provided with a recess 164 that is located and formed to match the shape of the access cover 310. In that manner, clearance in the shelf 162 is provided for the access cover 310, which may be recessed into the top cover as shown in FIG. 11.

The basin assembly 11 may further comprise at least one level switch 420 attached to the hanging member 415. The basin assembly 11 may be further comprised of a pump 20 (FIG. 2) disposed therein. The pump 20 may be operatively connected by a discharge pipe to an opening in the top cover 209 or in the side wall 102 of the basin 101. The provision of the access cover 310 in the top cover 209 enables easy installation of and access to the hanging member 415 and the level switches 420 and 470 attached thereto, without having to disconnect any piping connected to or passing through the top cover 209.

In accordance with the present disclosure, there is further provided a cover assembly for covering a vessel. The cover assembly comprises a main cover comprising a perimeter including a lower annular edge surface fastenable to an annular flange of a basin, at least a first opening connectable to a pipe, and a second opening surrounded by a first flat flange. An access cover is removably secured to the first flat flange of the main cover and comprises a hanging feature for suspending a hanging member therefrom.

In one embodiment, the hanging feature of the access cover may be formed in a similar manner to the engagement feature 230 of the main cover 210. This configuration of a hanging or engagement feature 230 of a main cover 210 has been previously described herein and shown in FIGS. 4-10. In another embodiment, the hanging feature may be formed in the access cover such that the hanging member disposed therein may be held in place when the access cover is joined to the top or main cover. An access cover with such a hanging feature, and a cover assembly including the access cover will now be described, and are best understood with reference to FIGS. 14A-14D.

Figures 14A, 14C:
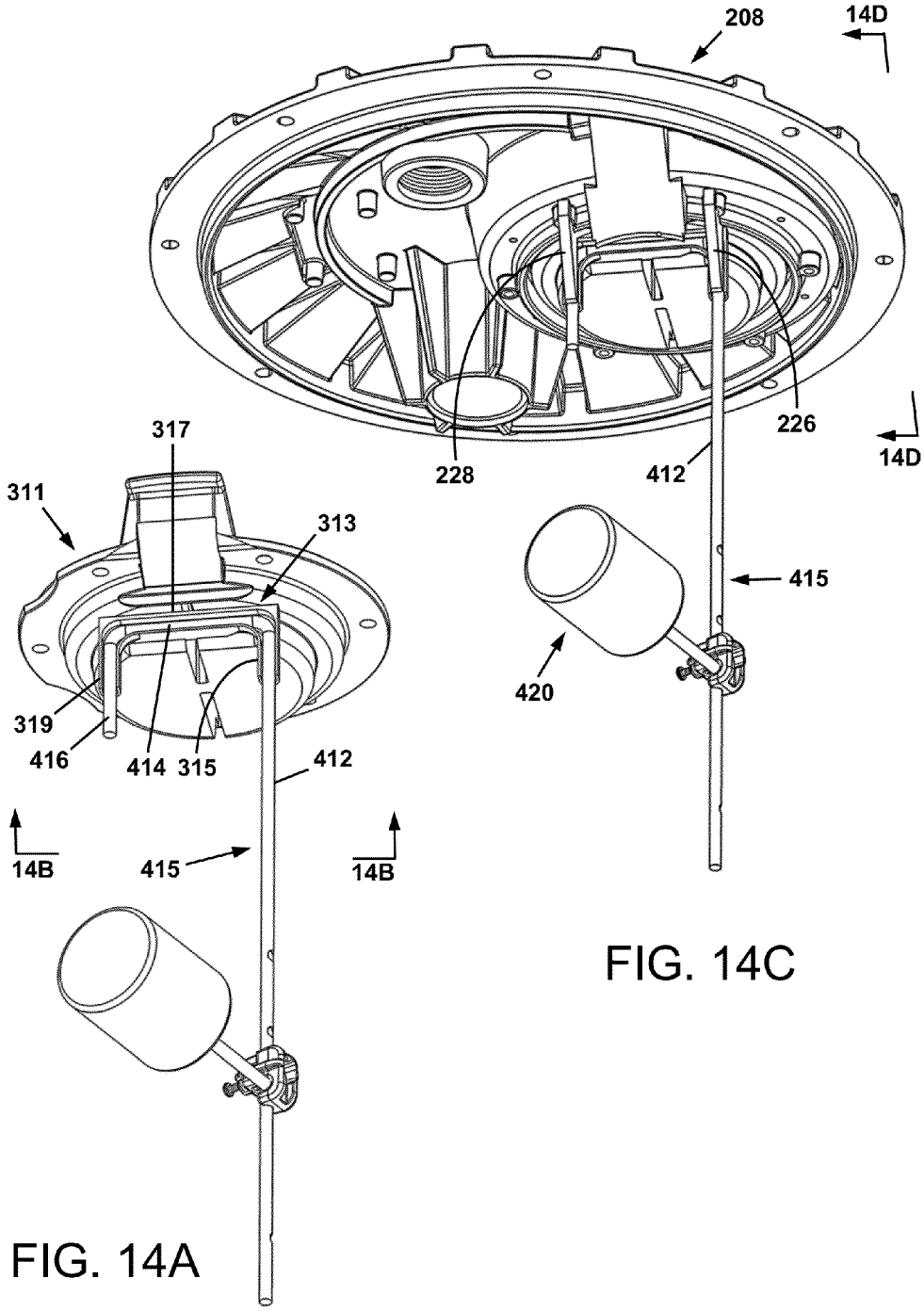
FIG. 14A is a lower perspective view of an access cover of a cover assembly, including a hanging feature formed in the access cover.
FIG. 14C is a perspective view of a cover assembly, including the access cover of FIG. 14A, taken from substantially the same vantage point as in FIG. 14A.
Figure 14D:
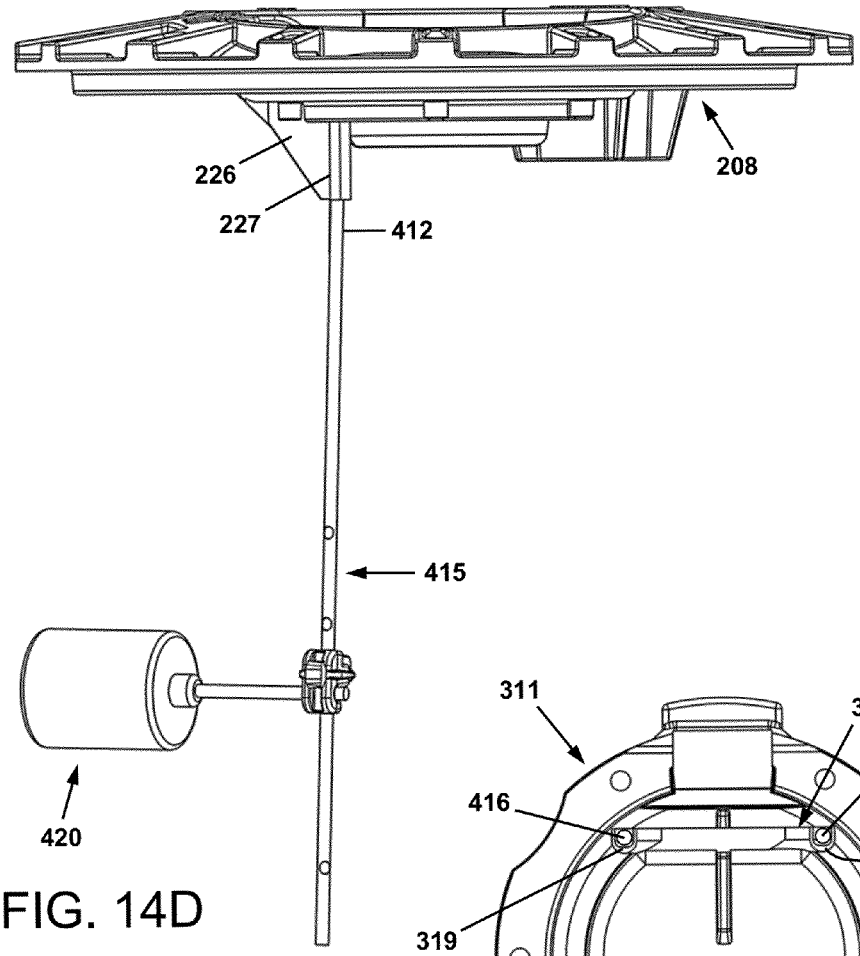
FIG. 14D is a side elevation view of the cover assembly of FIG. 14C, taken along the line 14D-14D of FIG. 14C.
Figure 14B:
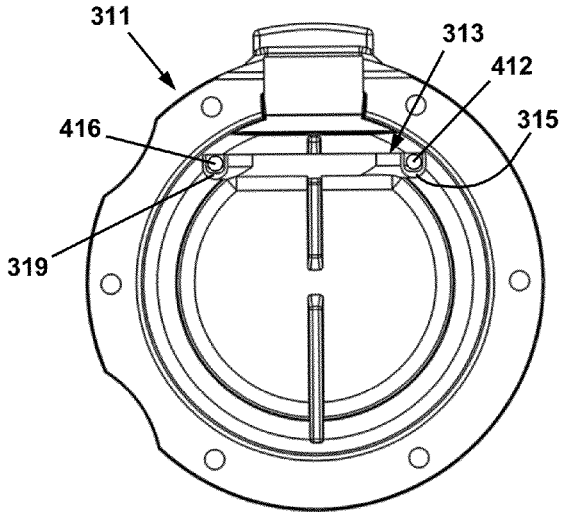
FIG. 14B is a bottom view of the access cover of FIG. 14A, taken along the line 14B-14B of FIG. 14A.

Referring first to FIGS. 14A and 14B, an access cover 311 is provided that is similar to access cover 310 shown in FIGS. 4 and 7-9 and described previously herein. Access cover 311 is further comprised of a hanging feature 313 for receiving a hanging member 415 therefrom. The hanging feature 313 and the hanging member 415 may have various forms. As described previously for hanging feature 150 of basin 101 (FIG. 11), the shape of the hanging feature 313 and the hanging member 415 are formed to match each other, such that the hanging feature 313 receives the hanging member 415. The following are meant to be illustrative of such forms of the hanging feature 313 and the hanging member 415, and not limiting.

The hanging feature 313 may be comprised of a vertical cavity, and the hanging member 415 comprised of an elongated vertical section extending through the vertical cavity. In the access cover 311 of FIGS. 14A and 14B, the hanging feature 311 is comprised of a vertical cavity or notch 315, with the hanging member 415 comprised of an elongated vertical section 412 extending downwardly through the vertical cavity 315. The vertical cavity 315 may be formed as a channel. The hanging feature 313 may further include a horizontal portion 317, with the hanging member 415 comprised of the elongated vertical section 412 extending from an upper horizontal section 414, the upper horizontal section 414 being disposed in the horizontal portion 317 of the hanging feature 313. The horizontal portion 317 of the hanging feature 313 may be a horizontal channel. The hanging member 415 may be a hook-shaped hanger rod including the upper horizontal section 414 thereof disposed in the horizontal portion 317. The hanging feature 313 may be further comprised of a second vertical cavity 319, which receives a second vertical section 416 of the hanging member. In one embodiment, the hanging member 414 may be partially embedded or fully embedded within the hanging feature 313 during the process of molding the access cover 311.

In another embodiment (not shown), the hanging feature 313 may be comprised of an arcuate channel transitioning to the first vertical cavity 315, and the hanging member 415 may be comprised of an elongated vertical section 412 extending from an arcuate-shaped upper section disposed in the arcuate channel of the hanging feature 313. In yet another embodiment (not shown), the hanging feature 313 may be a T-shaped cavity comprised of a horizontal upper channel, and a vertical channel extending downwardly from the horizontal channel. In such an instance, the hanging member may be a T-shaped rod formed to match the T-shaped cavity. For the above embodiments, to install the hanging member 415 into the hanging feature 313, the hanging member 415 is simply aligned with the hanging feature 313 and moved laterally into it. The hanging feature 313 may be sized slightly smaller than the hanging member 415, so that the hanging member 415 is retained in the hanging feature 313 by a mild interference fit therein.

The hanging feature 313 of the access cover 311 may be provided in a variety of locations in the lower portion of the access cover. One location may be proximate to the outer perimeter of the access cover 311, as shown in FIGS. 14A-14B. This outward location is accessible, as will now be explained with reference to FIGS. 14C and 14D. With the hanging feature located thusly, one or more retaining members 226 and 228 can be provided in the top cover 208, such that when the access cover 311 is fitted to the top cover 208, the retaining members 226 and 228 are proximate, i.e. in contact or nearly in contact with a portion of the hanging member 415 at or proximate to the hanging feature 313. In that manner, the joining of the access cover 311 to the main cover 208 secures the hanging member 415 within the hanging feature 313; its removal or dislodging is blocked by the retaining members 226 and 228 provided that they are positioned from the hanging feature 313 of the access cover 311 a distance that is less than the thickness of the hanging member 415.

The top cover 208 may be similar to cover 210 of FIGS. 2-10, but with at least one retaining member 226 provided for retaining the hanging member 415 in the hanging feature 313. The retaining members 226 and 228 may be formed as gussets, each of which has a substantially vertical surface (e.g. surface 227 of FIG. 14D), which is in contact or nearly in contact with the elongated vertical section 412 of the hanging member 415. It will be apparent that the retaining member may be provided in other forms, e.g. the retaining member may be a horizontal portion of material formed in the top cover 208 which is in contact or nearly in contact with the horizontal section 414 of the hanging member 415. It will be further apparent that the location of the hanging feature 313 and the hanging member suspended from it may be further inwardly disposed from the outer perimeter of the access cover 311, provided that the at least one retaining member 226 is inwardly disposed by a corresponding distance so as to provide the function of retaining the hanging member 415 in the hanging feature 313 as previously described.

In another embodiment (not shown), the hanging feature 313 may be provided in the main cover 208 in a manner similar to that described for access cover 311. The basin 100 (FIG. 2) may include the corresponding at least one retaining member formed in the side wall or in the flange thereof.

A liquid handling system including the above cover assembly may further include a basin for receiving a liquid, and a level switch assembly comprising at least one level switch attached to the hanger member, and a pump disposed in the basin. The basin, level switch assembly, and pump may be as described previously herein and shown in FIGS. 1-10.

It is therefore apparent that there has been provided, in accordance with the present disclosure, a liquid handling system, a basin cover assembly, a basin assembly, and a modular, easily installable, removable, and adjustable level control assembly for a liquid handling system. While the inventions of this disclosure have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A basin assembly for receiving a liquid, the basin assembly comprising:

a) a one piece molded body comprising a bottom wall and a side wall defining a volume for receiving a liquid, the volume having an inner circumference, and an open top, and a hanging feature formed in a shelf extending in an inward direction from the side wall proximate to the open top and vertically above and within the inner circumference of the volume for receiving liquid; and b) a hanging member formed to match the hanging feature, suspended therefrom within the body of the basin and unsupported by the bottom wall, the hanging member comprising a hook-shaped hanger rod extending downwardly from the hanging feature;

wherein the hanging feature is comprised of a horizontal channel and a vertical cavity, and the hook-shaped hanger rod is comprised of an elongated vertical section extending from an upper horizontal section, the upper horizontal section disposed in the horizontal channel of the hanging feature, and the elongated vertical section extending through the vertical cavity of the hanging feature.

2. A basin assembly for receiving a liquid, the basin assembly comprising:

a) a one piece molded body comprising a bottom wall and a side wall defining a volume for receiving a liquid, the volume having an inner circumference, and an open top, and a hanging feature formed in a shelf extending in an inward direction from the side wall proximate to the open top and vertically above and within the inner circumference of the volume for receiving liquid, the hanging feature comprised of a recessed pocket formed around a vertical cavity; and b) a hanging member formed to match the hanging feature, suspended therefrom within the body of the basin and unsupported by the bottom wall, the hanging member comprising a flange disposed in the recessed pocket and an elongated vertical rod section extending downwardly from the hanging feature through the vertical cavity.

3. A basin assembly for receiving a liquid, the basin assembly comprising:

a) a one piece molded body comprising a bottom wall and a side wall defining a volume for receiving a liquid, the volume having an inner circumference, and an open top, and a hanging feature formed in a shelf extending in an inward direction from the side wall proximate to the open top and vertically above and within the inner circumference of the volume for receiving liquid, the hanging feature comprised of an arcuate channel transitioning to a vertical cavity; and b) a hanging member formed to match the hanging feature, suspended therefrom within the body of the basin and unsupported by the bottom wall, the hanging member comprised of an elongated vertical rod section extending downwardly from an arcuate-shaped upper section disposed in the arcuate channel of the hanging feature.

4. A basin assembly for receiving a liquid, the basin assembly comprising:

a) a one piece molded body comprising a bottom wall and a side wall defining a volume for receiving a liquid, the volume having an inner circumference, and an open top comprised of an annular flange, and a hanging feature formed in a shelf extending in an inward direction from the side wall proximate to the open top and inwardly from the annular flange, the hanging feature located vertically above and within the inner circumference of the volume for receiving liquid; and b) a hanging member formed to match the hanging feature, suspended therefrom within the body of the basin and unsupported by the bottom wall, the hanging member comprising an elongated rod extending downwardly from the hanging feature.

5. The basin assembly of claim 4, wherein the shelf and annular flange are comprised of a downwardly extending lip.

6. The basin assembly of claim 1 wherein the hanging feature is formed in a shelf extending inwardly from the side wall of the body.

7. The basin assembly of claim 1, further comprising a top cover fastenable to the open top of the body.

8. The basin assembly of claim 7, wherein the open top of the body is comprised of an annular flange having a flat region, and the top cover is comprised of a perimeter including a lower annular edge surface fastenable to the annular flange.

9. The basin assembly of claim 7, further comprising an access cover removably secured to a flange surrounding an opening in the top cover.

10. A basin assembly for receiving a liquid, the basin assembly comprising:

a) a one piece molded body comprising a bottom wall, a side wall, an open top, and a hanging feature formed in a shelf extending in an inward direction from the side wall proximate to the open top;

b) a hanging member formed to match the hanging feature, suspended therefrom within the body of the basin and unsupported by the bottom wall, the hanging member comprising an elongated rod extending downwardly from the hanging feature;

c) a top cover fastenable to the open top of the body;

d) an access cover removably secured to a flange surrounding an opening in the top cover; and e) a gasket disposed between the flange of the top cover and the access cover, the gasket comprising a cord seal disposed between the top cover and the access cover.

11. The basin assembly of claim 9, wherein the flange is a flat flange.

12. The basin assembly of claim 9, wherein the flange is a radiused flange.

13. A basin assembly for receiving a liquid, the basin assembly comprising:

a) a one piece molded body comprising a bottom wall, a side wall, an open top, and a hanging feature formed in a shelf extending in an inward direction from the side wall proximate to the open top;

b) a hanging member formed to match the hanging feature, suspended therefrom within the body of the basin and unsupported by the bottom wall, the hanging member comprising an elongated rod extending downwardly from the hanging feature;

c) a top cover fastenable to the open top of the body; and d) a pump disposed within the body.

14. A cover assembly for covering a vessel, the cover assembly comprising:

a. a main cover comprising a perimeter including a lower surface fastenable to a basin, and a first opening surrounded by a first flange;

b. an access cover removably secured to the first flange of the main cover, and comprising a hanging feature comprised of a first cavity, a horizontal portion, and a second cavity; and c. a hanging member comprising a first elongated section extending vertically through the first cavity of the hanging feature, and joined to a horizontal section disposed in the horizontal portion of the hanging feature, and a second elongated section joined to the horizontal section and disposed in the second cavity of the hanging feature.

15. The cover assembly of claim 14, wherein the horizontal portion of the hanging feature is located within an arcuate channel.

16. The cover assembly of claim 14, wherein the main cover is comprised of at least one retaining member proximate to the hanging member.

17. The cover assembly of claim 14, further comprising a gasket disposed between the first flange of the main cover and the access cover, wherein the gasket comprises a cord seal disposed between the main cover and the access cover.

18. The cover assembly of claim 14, wherein the hanging member shape is J-shaped, L-shaped, U-shaped, or T-shaped.

19. The cover assembly of claim 16, wherein the retaining member is proximate to at least one of the first elongated section, the horizontal section, and the second elongated section of the hanging member, thereby blocking removal of the hanging member from the hanging feature.

20. A liquid handling system comprising:

a. a basin for receiving a liquid, the basin comprising a body comprised of a bottom wall, a side wall, and an open top;

b. a cover assembly for covering a vessel, the cover assembly comprising:

i. a main cover comprising a perimeter including a lower surface fastenable to the open top of the basin, and a first opening surrounded by a first flange; and ii. an access cover removably secured to the first flange of the main cover and comprising a hanging feature comprised of a first cavity, a horizontal portion, and a second cavity; and c. a level switch assembly comprising a hanging member comprised of a first elongated section extending vertically through the first cavity of the hanging feature, and joined to a horizontal section disposed in the horizontal portion of the hanging feature, and a second elongated section joined to the horizontal section and disposed in the second cavity of the hanging feature, and at least one level switch attached to the hanging member.

21. The liquid handling system of claim 20, further comprising a gasket disposed between the first flange of the main cover and the access cover, and comprising a seal disposed between the main cover and the access cover.

22. The liquid handling system of claim 20, further comprising a pump disposed within the basin.

23. A basin assembly for receiving a liquid, the basin assembly comprising:

a. a body comprising a bottom wall and a side wall defining a volume for receiving a liquid, the volume having an inner circumference, and an open top, and a hanging feature vertically above and within the inner circumference of the volume for receiving liquid and comprising a first cavity, a horizontal portion, and a second cavity; and b. a hanging member comprised of a one-piece formed rod including a first elongated section extending vertically through the first cavity of the hanging feature, transitioning to a horizontal section disposed on the horizontal portion of the hanging feature, transitioning to a second elongated section joined to the horizontal section and disposed in the second cavity of the hanging feature.

24. A basin assembly for receiving a liquid, the basin assembly comprising:

a. a body comprising a bottom wall and a side wall defining a volume for receiving a liquid, the volume having an inner circumference, and an open top, and a hanging feature vertically above and within the inner circumference of the volume for receiving liquid; and b. a hanging member comprised of a hook-shaped rod comprising a first vertical elongated section joined to a horizontal section;

wherein the hanging feature is formed with a first vertical cavity adjacent to a horizontal cavity, the cavities shaped to match the first vertical elongated section and the horizontal section, and wherein the hook-shaped hanger rod is disposed in the hanging feature with the first vertical elongated section received by the first vertical cavity, and the horizontal section received by the horizontal cavity.

25. The basin assembly of claim 24, wherein the hook-shaped rod is further comprised of a second vertical elongated section joined to the horizontal section, the hanging feature is formed with a second vertical cavity adjacent to the horizontal cavity, and the second vertical elongated section is received by the second vertical cavity.

26. The basin assembly of claim 24, wherein the hook-shaped rod is formed from a single piece of rod material.

* * * * *